United States Patent [19]

Glenn

[11] 4,084,922

[45] Apr. 18, 1978

[54] TURBINE ROTOR WITH PIN MOUNTED CERAMIC TURBINE BLADES

[75] Inventor: Robert G. Glenn, Huntingdon Valley, Pa.

[73] Assignee: Electric Power Research Institute, Inc., Palo Alto, Calif.

[21] Appl. No.: 754,722

[22] Filed: Dec. 27, 1976

[51] Int. Cl.[2] ..... F01D 5/32

[52] U.S. Cl. ..... 416/220 R; 416/193 A; 416/212 A; 416/215; 416/241 B; 416/248

[58] Field of Search ..... 416/219, 220, 248, 215, 416/193 A, 212 A, 212, 217, 241 B

[56] References Cited

U.S. PATENT DOCUMENTS

| | | | |
|---|---|---|---|
| 2,271,971 | 2/1942 | Doran | 416/219 |
| 2,658,718 | 11/1953 | Walker | 416/220 X |
| 2,781,998 | 2/1957 | Barr | 416/220 |
| 2,805,838 | 9/1957 | Pickup | 416/217 X |
| 2,873,947 | 2/1959 | Perry | 416/241 B X |
| 2,957,675 | 10/1960 | Mason et al. | 416/220 |

FOREIGN PATENT DOCUMENTS

| | | | |
|---|---|---|---|
| 826,332 | 12/1951 | Germany | 416/214 A |
| 15,893 of | 1908 | United Kingdom | 416/217 |
| 189,131 | 3/1923 | United Kingdom | 416/193 A |
| 731,456 | 6/1955 | United Kingdom | 416/220 |
| 1,008,903 | 11/1965 | United Kingdom | 416/215 |

*Primary Examiner*—Everette A. Powell, Jr.
*Attorney, Agent, or Firm*—Townsend and Townsend

[57] ABSTRACT

An improved rotor for a gas turbine engine wherein the rotor has a plurality of ceramic turbine blades coupled by attachment pieces of high-temperature metal to a rotor disk. Each attachment piece has a root received in a corresponding groove in the outer periphery of the rotor disk. Also, each attachment piece is made to couple a pair of turbine blades to the rotor disk, the attachment piece having a pair of axially spaced, radially extending walls, each wall having a hole therethrough and the holes of the walls being aligned with each other. The roots of the two blades for each attachment piece are positioned between its spaced wall and the roots have cooperating projecting parts which engage each other and form a recess through which a pin extends when the ends of the pin are in the holes of the end walls. The roots of the blades of adjacent attachment pieces abut each other to keep the blades from moving laterally relative to respective attachment pieces.

10 Claims, 4 Drawing Figures

TURBINE ROTOR WITH PIN MOUNTED CERAMIC TURBINE BLADES

This invention was made under contract with or supported by the Electric Power Research Institute, Inc.

This invention relates to improvements in rotors for gas turbine engines and, more particularly, to an improved structure for mounting ceramic turbine blades on a rotor disk of such an engine.

BACKGROUND OF THE INVENTION

The efficiency of a gas turbine engine may be improved by raising the turbine inlet gas temperature. At the present state of the art, such temperature is limited by the properties of known metals. Cooling air may be introduced to protect such metals when they are used to form parts of the turbine, but beyond a certain point, a trade-off of loss of air overrides the gain achieved by the use of the air.

Ceramic materials are currently under investigation for use in making turbine blades. There are major problems associated with the use of ceramic materials. Shapes and sizes are limited by manufacturing techniques and simplicity of shape is required to accommodate the low heat transfer characteristics of ceramic materials, to avoid stress rises due to the brittleness of the material, and to facilitate manufacturing of the blades themselves. Another major problem is to establish how to attach a ceramic blade to a rotor disk of metal. The common fir tree roots are not acceptable for use on ceramic turbine blades because of the low ductitility of ceramic materials which prevents substantially uniform distribution of loads to each land of such a root. Moreover, the metal rotor disk must be protected from exposure to the hot gases to which the blades are subjected.

Because of the problems mentioned above, a need has arisen for an improved means of mounting ceramic turbine blades on a metallic rotor disk of a turbine engine so that increased efficiency of the engine can be realized even though the turbine blades of the engine are formed from ceramic materials.

SUMMARY OF THE INVENTION

The present invention satisfies the foregoing need by providing a turbine rotor having improved attachment means for coupling the roots of a plurality of ceramic turbine blades thereto. To this end, the attachment means includes a number of attachment pieces of high-temperature metal having roots received within outer peripheral grooves of the rotor disk of the rotor, there being an attachment piece for each pair of turbine blades, respectively. Each attachment piece has a pair of axially spaced, radially extending walls provided with aligned, pin-receiving holes therein, with the space between each wall being of sufficient size to receive and position the roots of a corresponding pair of turbine blades. The bases of the two blades have spaced, projecting parts which engage in a manner to form a recess aligned with the holes in the end walls of the attachment piece to receive a pin which prevents outward radial movement of the blades with respect to the attachment piece. The bases of the blades of adjacent attachment pieces abut each other so that the blades cannot move circumferentially out of the space between the walls of corresponding attachment pieces. In this way, the blades of the rotor are effectively held in place on the rotor disk even during high-speed rotation thereof.

The blade roots also serve to shield or isolate the rotor disk from the high-temperature gases to which the blades themselves are subjected. This prevents structural damage due to thermal stresses in the rotor disk and avoids having to provide external coolant means thereto. The fact that a single attachment piece is provided for a pair of blades permits the attachment piece to be relatively large, thereby more rugged to withstand mechanical and thermal stresses. This also allows the roots of the turbine blades to be relatively large and to simplify the construction of the roots. By providing a single pin for each of a pair of blades, the pin diameter can be twice the diameter of a pin for each blade, respectively, for the same blade base cross section. Thus, the sheer area of the pin is four times larger than such a pin for a single blade. If desired, the fir tree root of the intermediate attachment piece can be cooled where it attaches to the rotor disk.

The primary object of this invention is to provide an improved turbine rotor for a gas turbine engine wherein the rotor has a plurality of turbine blades of ceramic material coupled by an approvied attachment means to the outer periphery of a rotor disk so that the turbine blades will be positively secured to the rotor disk at all times notwithstanding the high rotational speeds associated therewith.

Another object of this invention is to provide a turbine rotor of the type described wherein the blades are mounted by pins to intermediate attachment pieces which, in turn, are secured to the outer periphery of a rotor disk so as to prevent movement of the blades away from the rotor disk yet the rotor disk itself is shielded by the attachment pieces and the bases of the blades from the harmful effects of the high-temperature gases to which the blades are subjected when in use.

Still another object of this invention is to provide a turbine rotor of the aforesaid character wherein each pair of blades of the rotor is received between a pair of axially spaced, radially extending end walls of a respective attachment piece and a pin extends through the walls and through a recess formed by the engagement of spaced projecting parts on the bases of the two blades to prevent movement of the blades away from the attachment piece yet the blade base shields the rotor disk from the hot gases of the turbine.

Other objects of this invention will become apparent as the following specification progresses, reference being had to the accompanying drawings for an illustration of the present invention.

IN THE DRAWINGS

Figure 4:
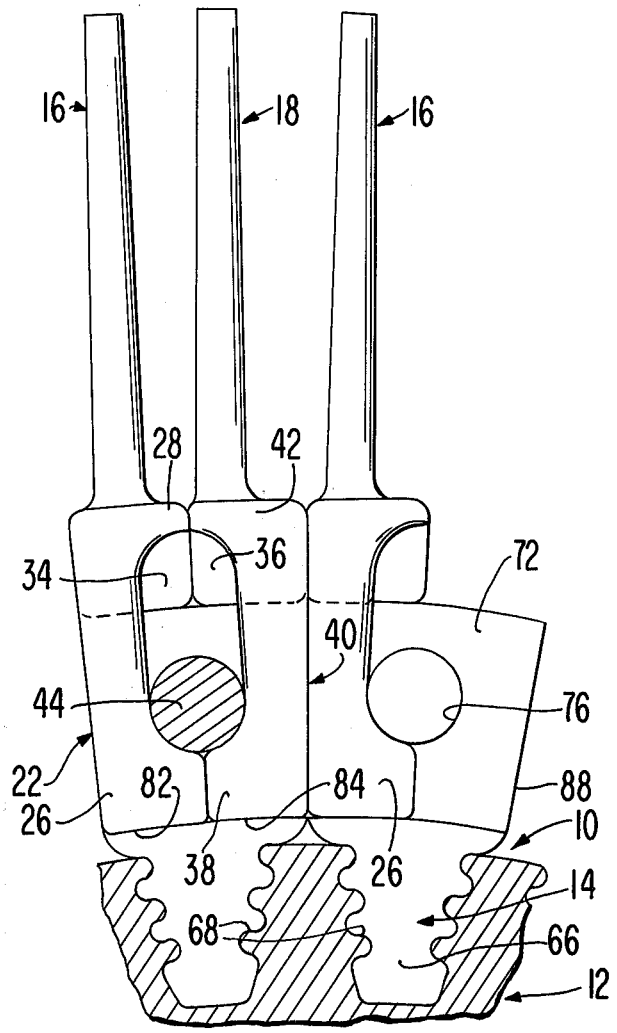
FIG. 4 is an end elevational view of a portion of a rotor disk showing a pair of attachment pieces mounting several turbine blades on the rotor disk.

A turbine rotor 10 for use with a gas turbine engine is illustrated fragmentarily in FIG. 4 and includes a rotor disk 12, a number of attachment pieces 14, and a pair of turbine blades 16 and 18 for each attachment piece 14, respectively. Disk 12 is adapted to be mounted for rotation about a central axis and to be rotated about such axis when hot gases impinge upon blades 16 and 18.

Figure 1:
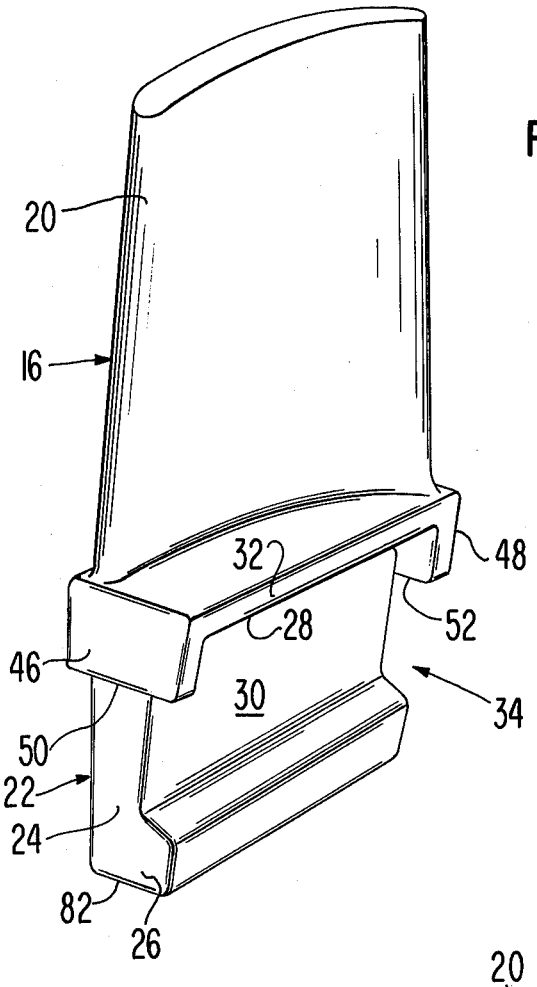
FIG. 1 is a perspective view of a turbine blade of ceramic material forming a part of the present invention.

Blade 16 is illustrated in FIG. 1 and includes a radial outer blade portion 20 which is to be subjected to the hot gases and a base 22 integral with blade portion 20. Base 22 is provided with a first laterally projecting part 26 at the radially innermost end thereof. A second laterally projecting part 28 extends from innder side face 30 in spaced relationship to part 26. Parts 26 and 28, because they project laterally from face 30 present an open recess 34 which mates with a corresponding open recess 36 (FIG. 4) of blade 18, recess 36 being formed by a laterally projecting part 38 on the radially innermost end of base 40 of blade 18 and by a laterally projecting part 42 spaced from part 38 and adjacent to part 28 of blade 16 (FIG. 4). Thus, recesses 34 and 36 (FIG. 4) form a closed recess when blades 16 and 18 are mated together with parts 26 and 38 in abutment with each other and when parts 28 and 42 are in abutment with each other. This recess is adapted to receive a pin 44 in a manner to be described.

Figure 3:
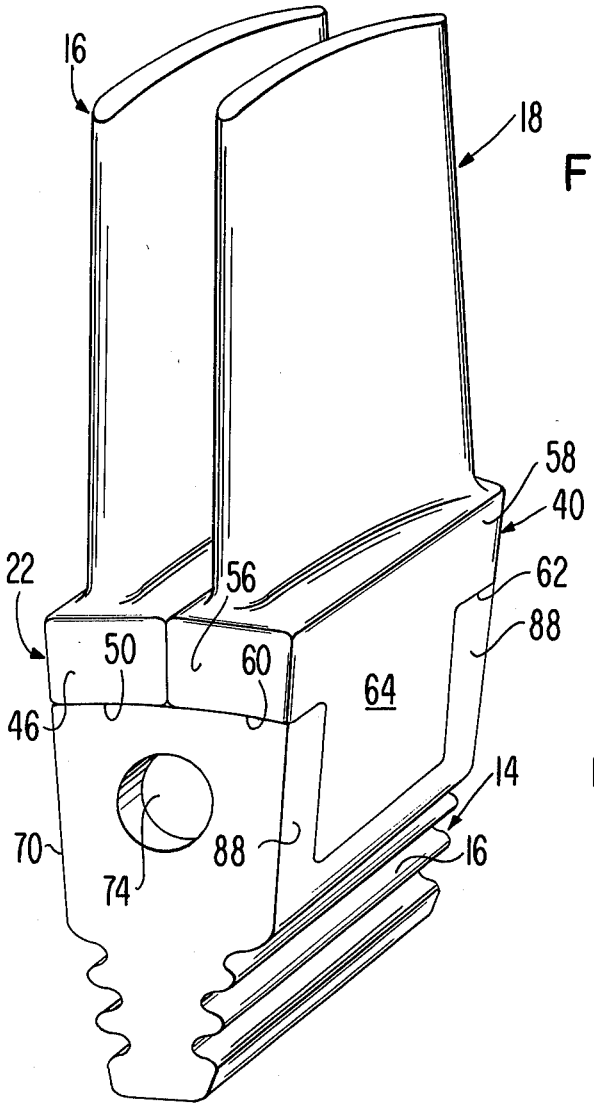
FIG. 3 is a view similar to FIG. 2 but showing two turbine blades mounted on the attachment piece.

Another feature of blade 16 is the pair of shoulders 46 and 48 at the opposed ends of projecting part 28 thereof (FIG. 1), shoulders 46 and 48 presenting slightly curved lower faces 50 and 52 for a purpose hereinafter described. Also, base 22 of blade 16 has a flat, outer side face 54 opposed to inner side face 30. Similarly, blade 18 has shoulders 56 and 58 provided with slightly curved lower surfaces 60 and 62 (FIG. 3) and a flat outer side surface 64 corresponding to face 54 of blade 16.

Each attachment piece 14 has a fir tree root 66 for insertion into a corresponding groove 68 in the outer periphery of rotor disk 12. Each attachment piece 14 further includes a pair of axially spaced, radially extending walls 70 and 72, the walls having centrally disposed holes 74 and 76, the holes being aligned with each other for receiving pin 44.

Figure 2:
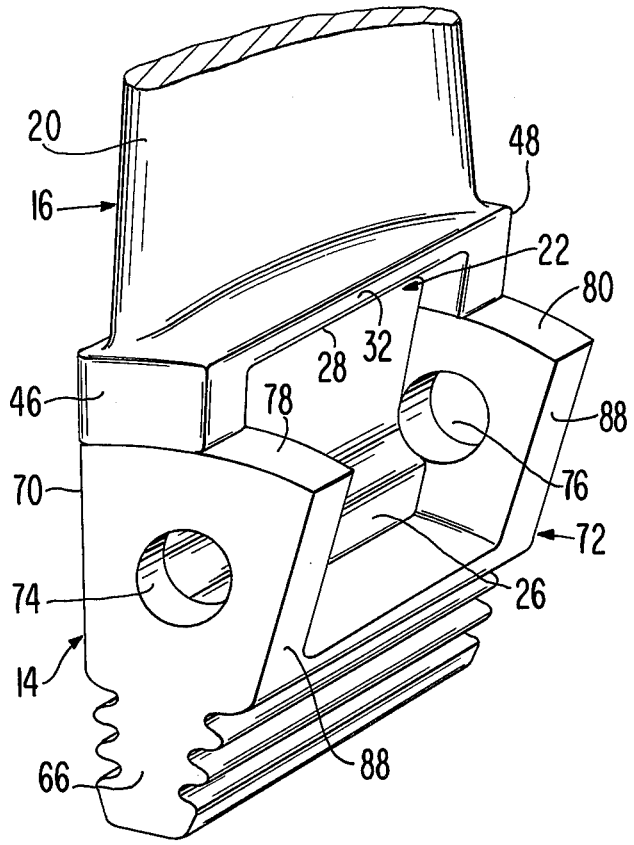
FIG. 2 is a perspective view of a part of the blade and an attachment piece coupling the same to a rotor disk wherein the base of the blade is shown in a mounted position on the attachment piece.

The outer faces 78 and 80 of walls 70 and 72 (FIG. 2) are slightly curved and are adapted to be engaged by faces 50 and 52 of shoulders 46 and 48 of blade 16 and by surfaces 60 and 62 of shoulders 56 and 58 of blade 18. Moreover, the radially innermost faces 82 and 84 (FIG. 4) of blades 16 and 18 are adapted to be supported on and engage the slightly curved face 86 (FIG. 2) of attachment piece 14 at the radially outermost part of root 66.

The sides of each of walls 70 and 72 are flat and converge as root 66 is approached. These sidewalls are indicated by the numerals 88. The corresponding hole 74 or 76 is located midway between the corresponding sidewalls 88.

In use, the various attachment pieces 14 are coupled to rotor disk 12 by inserting the corresponding roots 66 in respective grooves 68 of the rotor disk. Then, the blades are coupled to respective attachment pieces, each pair of blades 16 and 18 having their bases inserted between the walls 70 and 72 of the corresponding attachment piece 14. When each pair of blades are in the operative positions shown in FIG. 2, pin 44 can be inserted through hole 74, through the closed recess formed by mating open recesses 34 and 36 of the two blades, then into the other hole 76. The pin may be solid metal with a head and be locked in place by a snap ring or other standard device. In the alternative, the pin may be simply a spring pin which is self-retaining. The pin prevents radial outward movement of either of the blades with respect to the corresponding attachment piece. When all of the blades are mounted in place, outer faces 54 of blade 16 abut outer side surfaces 64 of the adjacent blade 18. Thus, the blades are held against circumferential movement relative to their attachment pieces. In this way, the blades are effectively held in place and will remain so even under the effects of high-speed rotation of the rotor disk.

I claim:

1. In a gas turbine rotor: a rotor disk having an outer periphery; a plurality of blade attachment pieces coupled to the outer periphery of the rotor disk and extending outwardly therefrom, each attachment piece including a root and a pair of axially spaced, radially extending end walls coupled with the root; and a pair of ceramic rotor blades for each attachment piece, respectively, each blade having a base and a blade portion extending outwardly from the base, the bases of the pair of blades of each attachment piece being disposed between the end walls of the attachment piece, each base being provided with an open recess, the open recesses of the bases mating with each other to form a closed recess; and pin means carried by the end walls of each attachment piece, respectively, and extending through the closed recess for coupling the blades to the attachment pieces.

2. In a gas turbine rotor as set forth in claim 1, wherein each end wall of each attachment piece has an outer peripheral face, each blade having a shoulder engaging the end faces of the end walls of the respective attachment piece.

3. In a gas turbine rotor as set forth in claim 1, wherein each end wall has a hole therethrough, the holes of the end walls of each attachment piece being aligned with each other and with the mated recesses of the bases of the corresponding pair of blades, said pin means including a pin extending through the holes of the end walls of each attachment piece, respectively, and through the corresponding mated recesses.

4. In a gas turbine rotor as set forth in claim 1, wherein each end wall has a pair of opposed, generally flat sides converging as the root of the corresponding attachment piece is approached, the flat sides of the end walls of adjacent attachment pieces being in substantial abutment with each other.

5. In a gas turbine rotor as set forth in claim 4, wherein each end wall has a hole therethrough substantially midway between the sides thereof, said pin means extending through the holes in the end walls.

6. In a gas turbine rotor as set forth in claim 4, wherein the base of each blade has a flat outer side face, the outer side faces of the bases of the blades of adjacent attachment pieces being in substantial abutment with each other.

7. In a gas turbine rotor as set forth in claim 1, wherein the base of each blade has a pair of radially spaced projecting parts defining the corresponding recess therebetween.

8. In a gas turbine rotor as set forth in claim 7, wherein said projecting parts span the distance between the end walls of the corresponding attachment piece.

9. In a gas turbine engine as set forth in claim 8, wherein the radially outermost one of the projecting parts has a pair of shoulders at respective, opposed ends thereof, the shoulders engaging the radially outermost portions of the end walls.

10. In a gas turbine rotor: a rotor disk having an outer periphery provided with a plurality of grooves therein;

a plurality of blade attachment pieces coupled to the outer periphery of the rotor disk and extending outwardly therefrom, each attachment piece including a root inserted in a corresponding groove of the rotor disk, and a pair of axially spaced, radially extending end walls coupled with the root, each end wall having a pair of opposed, flat sides, the flat sides being convergent as the corresponding root is approached; and a pair of ceramic rotor blades for each attachment piece, respectively, each blade having a base and a blade portion extending outwardly from the base, the bases of the pair of blades of each attachment piece being disposed between the end walls of the attachment piece, a first side of each base having a pair of laterally projecting parts, the projecting parts of one base engaging the projecting parts of the adjacent base to form a recess therebetween, said end walls of each attachment piece having respective holes aligned with the corresponding recess; and a pin extending through the holes and said recess to couple the blades to the corresponding attachment piece, the sides of the end walls of each attachment piece engaging the sides of the end walls of adjacent atachment pieces.

* * * * *